US005984466A

United States Patent [19]

Nagashima et al.

[11] Patent Number: 5,984,466

[45] Date of Patent: Nov. 16, 1999

[54] INK JET RECORDING METHOD FOR PRODUCING PRINTED IMAGES HAVING WATER-FASTNESS

[75] Inventors: Akira Nagashima; Ryuichi Arai, both of Tokyo, Japan

[73] Assignee: Canon Kabushiki Kaisha, Tokyo, Japan

[21] Appl. No.: 08/729,518

[22] Filed: Oct. 11, 1996

Related U.S. Application Data

[63] Continuation of application No. 08/222,874, Apr. 5, 1994, abandoned.

[30] Foreign Application Priority Data

Apr. 13, 1993 [JP] Japan ..... 5-108806
Feb. 25, 1994 [JP] Japan ..... 6-051126

[51] Int. Cl.[6] ..... B41J 2/01

[52] U.S. Cl. ..... 347/101; 347/100; 347/98

[58] Field of Search ..... 347/101, 100, 347/98

[56] References Cited

U.S. PATENT DOCUMENTS 4,642,654 2/1987 Toganoh et al. .
4,695,846 9/1987 Suzuki ..... 347/100
4,733,247 3/1988 Arai et al. .

FOREIGN PATENT DOCUMENTS 3434875 10/1985 Germany ..... 347/101
55-041240 3/1980 Japan .
04197637 7/1992 Japan ..... 347/101

*Primary Examiner*—Valerie Lund
*Attorney, Agent, or Firm*—Fitzpatrick, Cella, Harper & Scinto

[57] ABSTRACT

An ink jet recording method in which a water-based ink containing a recording agent is attached to a recording surface of a recording medium by an ink jet system, and liquid water is applied to the recording medium at a suitable time proximate to the time of applying the ink. A period of time is set during which a state in which the water-based ink is in a liquid form in the recording surface coexists with a state in which liquid water other than water contained in the water-based ink exists in a portion of the recording medium other than the recording surface.

18 Claims, 6 Drawing Sheets

INK JET RECORDING METHOD FOR PRODUCING PRINTED IMAGES HAVING WATER-FASTNESS

This application is a continuation of application Ser. No. 08/222,874 filed Apr. 5, 1994, now abandoned.

BACKGROUND OF THE INVENTION

1. Field of the Invention

This invention relates to an ink jet recording method of ejecting ink by a pressure wave caused in ink in an ink flow passage to perform recording. In particular, the present invention relates to an ink jet recording method which ensures that the water-fastness property of a printed image formed on a recording medium, particularly plain paper, can be remarkably improved. The present invention also relates to a method of making a water-resistant printed matter by using a water-soluble dyestuff. Throughout the specification, the term "water-fastness" means the characteristic of an image to not run when subjected to water. Further, the term "image" means any of characters, shapes, figures, . . . etc.

2. Description of the Related Art

In conventional ink jet recording methods of jetting ink by a pressure wave caused in ink in an ink flow passage to perform recording, inks having water-soluble recording agents (coloring materials) are used.

However, there is the problem of inferior water-fastness properties of recording materials such as inks comprised of water-soluble recording agents. If water of rain or the like contacts a printing recording surface of a recording material after printing with such inks, the printed recording material flows and printed characters or images are blotted.

Water-based inks containing water-soluble recording agents are used in many ink jet printers because they have improved ejection and printing characteristics. It is important to improve the water-fastness property of printed matter made by using such inks.

Japanese Patent Laid-Open No. 55-41240 discloses a method of supplying water to a printing surface of paper before printing to prevent a background contamination caused by ink spattering during printing and to improve an ink absorbing property.

However, if this method is used, blurring of printed portions is considerable and satisfactory printing qualities cannot be obtained.

SUMMARY OF THE INVENTION

An object of the present invention is to provide an ink jet recording method in which ink is ejected by a pressure wave caused in ink in an ink flow passage to perform recording, and which ensures that a printed image obtained by using a water-based ink containing a water-soluble recording agent is free from blurring and has an improved water-fastness property, and to provide a method of making a printed matter with water-fastness.

To achieve this object, according to one aspect of the present invention, there is provided an ink jet recording method comprising the steps of attaching a water-based ink containing a recording agent to a recording surface of a recording medium by an ink jet system, and applying liquid water to the recording medium, such that for a period of time the water-based ink, when in a liquid form in the recording surface, coexists with liquid water other than water contained in the water-based ink, when in a portion of the recording medium other than the recording surface.

According to another aspect of the invention, there is provided an ink jet recording method comprising the steps of recording by applying droplets of ink containing a water-soluble dyestuff to a recording medium, and applying liquid water, the amount of which is 7 to 20% of the weight of the recording medium, to a reverse surface of the recording medium at at least one of a time before the recording step, a time during the recording step and a time after the recording step.

According to still another aspect of the invention, there is provided a method for providing water-fastness property to a printed image formed by applying droplets of ink containing a water-soluble dyestuff to a recording medium, the method comprising applying liquid water to a reverse surface of the recording medium at at least one of a time before the application of ink, a time during the application of ink and a time after the application of ink.

According to a further aspect of the invention, there is provided a method for producing a water-fastness printed image formed by applying droplets of ink containing a water-soluble dyestuff to a recording medium, the method comprising applying liquid water to a reverse surface of the recording medium at: at least one of a time before the application of ink, a time during the application of ink and a time after the application of ink.

DESCRIPTION OF THE PREFERRED EMBODIMENTS

Figure 1:
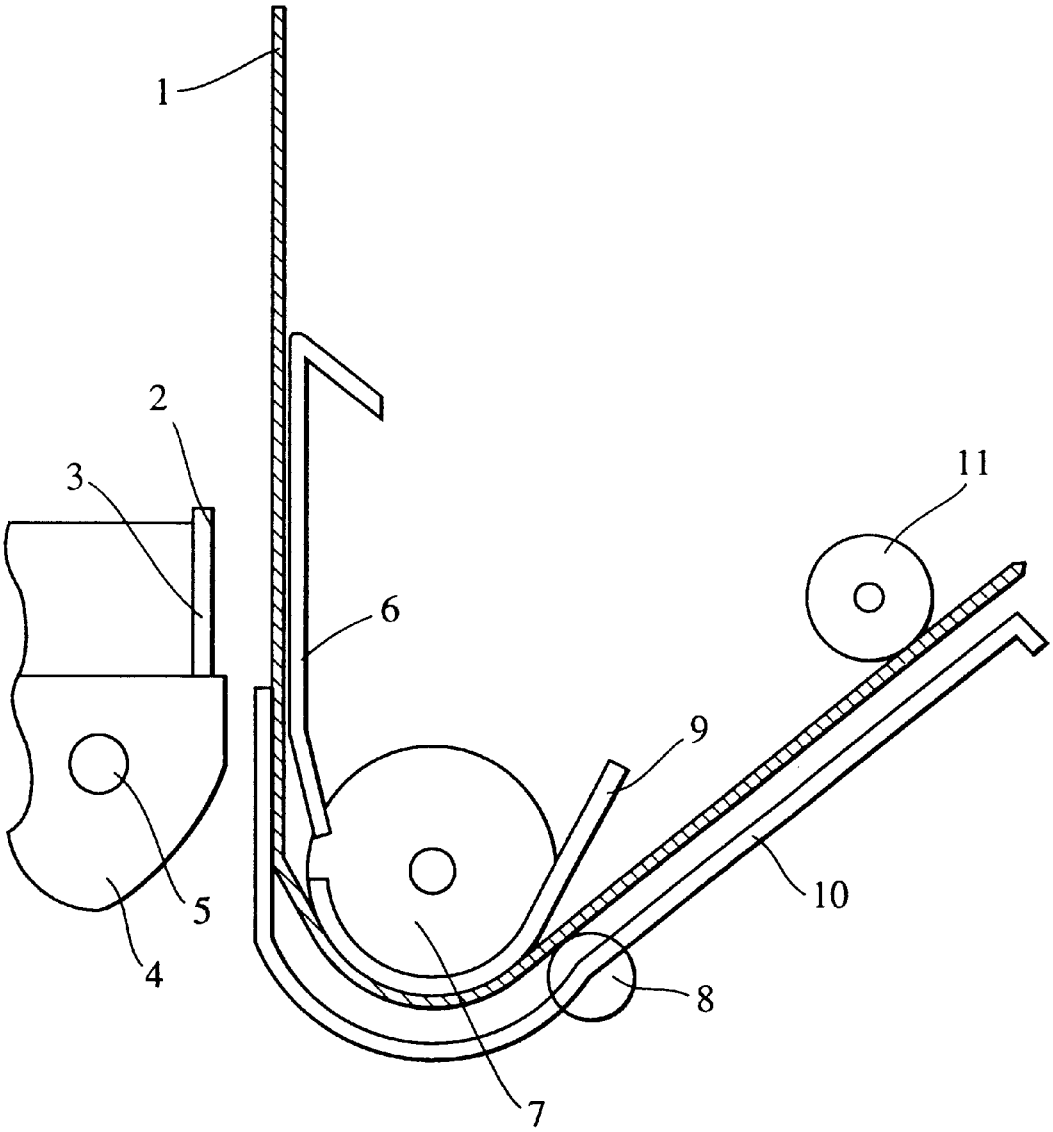
FIG. 1 is a schematic longitudinal sectional view of an ink jet recording apparatus to which the ink jet recording method of the present invention is applied.

In general, if printing is performed on a recording medium by using an ink containing a water-soluble recording agent, a solvent and other components, the recording agent, the solvent and other components remain on the recording medium. In such a case, the recording agent forming a printed portion does not sufficiently color the recording medium because of the influence of the solvent or other causes. If a liquid such as water is applied to the print, the recording agent starts dissolving since it is water-soluble. That is, the printed ink is in a state of being inferior in water fastness.

Studies have been conducted in consideration of the problems of the conventional art and this invention has been achieved based on a finding that if printing is performed while a reverse surface of a recording medium is moistened with liquid water, or if the reverse surface of the recording medium is moistened with liquid water after print recording, an osmotic pressure phenomenon occurs in the recording medium so that only a recording agent in ink remains on the printed surface of the recording medium while a solvent and other components disperse to a non-printed portion of the recording medium or to a position in the recording medium at the back of the printed recording surface, whereby the recording agent can sufficiently color the recording surface of the recording medium without causing blurring of the printed portion while the water fastness property of the printed ink is remarkably improved.

That is, it is thought that the water-fastness property of the printed ink can be improved by providing liquid water in the reverse surface of the recording medium for the reason described below.

Ordinarily, water in fibers of paper used as a recording medium is in a state of combining with fiber molecules as in the case of crystallized water in various inorganic salts, and hardly have the intrinsic function of liquid water as a solvent. However, if liquid water is intentionally applied to the recording medium in such a situation, free water capable of functioning as a solvent can be caused to exist in gaps between fibers.

On the other hand, water-based inks used by ink jet recording methods are ordinarily formed of at least water, a coloring material (recording agent), such as a dyestuff, and a water-soluble organic solvent, and may also contain, according to the desired performance, various additives for controlling the surface tension, the viscosity, pH and other ink characteristic values.

In particular, inks using water-soluble dyestuffs as recording agents are prescribed and designed to improve the solution stability of the dyestuffs in ink by adding a material for promoting the salvation, i.e., ion pairs, a chelating agent or the like, (hereinafter referred to as a dyestuff solubility stabilizing material) to the dyestuffs. However, such a dyestuff solubility stabilizing material also acts to induce an effect of reducing the water-fastness property of printed ink.

However, if an ink prescribed and designed as described above is used for recording on a recording medium to which free liquid water Ls intentionally applied, a dyestuff solubility stabilizing agent in ink, i.e., ion pairs, a chelating agent or the like, added as mentioned above, moves successively from recorded ink dot portions to free water in the recording medium because of the difference between osmotic pressures thereof.

That is, the (concentration of the dyestuff solubility stabilizing material in ink is distinctively higher than that in free water, and free water existing in gaps between fibers in the recording medium is in a thermodynamic condition such as to be able to develop intrinsic osmotic pressure energy of water as a solvent. Therefore, the dyestuff solubility stabilizing material in ink moves from a dyestuff in ink to free water by osmotic pressure.

As a result, the dyestuff in ink loses the means for stabilizing its solubility in water, so that it is not easily dissolved again even if it is exposed to water in a water-fastness test or the like after printing.

That is, if printed ink obtained by the conventional printing method, in which a dyestuff solubility stabilizing material exists locally in printed ink dot portions, undergoes a water-fastness test, dyestuff in the printed portion is naturally dissolved again. In contrast, in the method of the present invention, a dyestuff solubility stabilizing material is diffused throughout the recording medium by the effect of free liquid water, and the concentration of the dyestuff solubility stabilizing material in printed dot portions is thereby reduced so that the dyestuff cannot be dissolved again.

The present invention will be described in more detail with respect to preferred embodiments thereof.

The method of applying liquid water to a recording medium in accordance with the present invention comprises, for example, methods of bringing a roller containing liquid water into contact with a reverse surface of a recording medium.

More specifically, such methods include a method of forming fine holes in a roller surface and impregnating the holes with liquid water so that liquid water can move into a recording medium by osmotic pressure when the recording medium is brought into contact with the roller, and a method of providing a porous member formed of, for example, urethane, cellulose or the like around a roller so that liquid water is applied to a recording medium when the recording medium is brought into contact with the porous member.

Another method in which liquid water is applied to a reverse surface of a recording medium is by using a humidifier.

Further, a method of bringing a brush-like member having capillaries into contact with a recording medium may be used. That is, the capillaries are filled with liquid water and the liquid water is applied to a recording medium by osmotic pressure or capillary phenomenon or the like.

In accordance with the present invention, liquid water is applied to a recording medium so that the recording medium is moistened with liquid water during or after recording on the recording medium and, for this effect, the step of applying liquid water may be set immediately before or immediately after recording or both immediately before and after recording.

For example, if liquid water is applied to a reverse surface of a recording medium after recording, the solvent and the dyestuff solubility stabilizing material disperse into a reverse side portion and other portions of the recording medium where there is no printed recording material so that only recording agents remain mainly in the portion where a recording material is printed. The water-fastness property of the printed recording material is thereby improved.

Any liquid water may be applied to a recording medium used in accordance with the present invention, as long as it is sufficiently clear as not to color the recording medium when dried. For example, such liquid water may be city water used as domestic drinking water, or water with a water solvent used as a component of an ink used in accordance with the present invention.

It is undesirable that the amount of liquid water applied to a recording medium be excessively small or large. For example, if the recording medium is plain paper, it is desirable to set the amount of liquid water to be about 7 to 20 wt % and, more preferably, 7 to 15 wt % per unit area of the recording medium.

Recording agents provided as components of an ink used in accordance with the present invention are not particularly limited, and may be selected from various water-soluble dyestuffs. However, they are, preferably, direct dyestuffs.

The amount of such dyestuffs is not particularly limited. Generally, however, it is within the range of, preferably, 0.1 to 15 wt % and, more preferably, 0.1 to 10 wt % of the total weight of the ink.

A liquid medium constituting the ink used in accordance with the present invention is, preferably, a mixture of water and at least one water-soluble organic solvent.

Examples of the water-soluble organic solvent are amides, such as dimethylformamide and dimethylacetamide, acetone and other ketones, ethers, such as tetrahydrofuran and dioxane, alkylene glycols having an alkylene group including 2 to 6 carbon atoms, such as polyethylene glycol, 1, 2, 6-hexanetriol, thioglycol, hexylene glycol, diethylene glycol, dipropylene glycol and propylene glycol, lower alkyl ethers of polyhydric alcohols, such as glyceriol, ethylene glycol monomethyl (or ethyl) ether, diethylene glycol monomethyl (or ethyl) ether and triethylene glycol monomethyl (or ethyl) ether, N-methyl-2-pyrrolidone, 1, 3-dimethyl-2-imidazolidinone, triethanolamine, sulfolane and dimethylsulfoxide.

Generally, the content of the water-soluble organic solvent is 1 to 40 wt % and, more preferably, 3 to 30 wt % of the total weight of ink.

The content of water in ink is set within the range of 30 to 90 wt %. If the water content is smaller than 30 wt %, the solubility of the recording agents is considerably low and the viscosity of ink is also undesirably high. If the water content is larger than 95 wt %, the amount of evaporated components is so large that suitable solidification or fixing characteristics cannot be achieved.

Further, the ink used in accordance with the present invention may contain, as well as the above-mentioned components, other various additives such as a surfactant, a rust inhibitor, an anticeptic, an antimold, an evaporation accelerator, a chelating agent and a water-soluble polymer selected according to one's need.

The recording method of the present invention can be applied particularly suitably to an ink jet recording system in which ink is ejected by foaming of ink with thermal energy. Specifically, in such a system, the recording method of the invention makes it easy to improve the density, the printing quality and the water resisting property of the print.

This may be because the method of fixing ink printed on a recording member in the ink jet recording system is mainly based on natural permeation and evaporation. Also, in such a case, thermal physical property values of ink to be used (e.g., specific heat, thermal expansion coefficient and thermal conductivity) may be adjusted.

Further, considering the effect of solving the problem of the water-fastness property of a print recorded on plain paper or the like and the effect of improving the printing density, printing qualities and matching with an ink jet recording head, it is desirable that particular physical properties of the ink used in the recording method of the present invention be adjusted so that at 25° C. the surface tension is 30 to 68 dyne/cm and the viscosity is 15 cP or less, more preferably, 10 cP or less, and most preferably, 5 cP or less.

Examples of applications of the method of the present invention will be described with reference to the drawings.

FIG. 1 schematically illustrates a system in which a porous roller 11 containing water is brought into contact with a recording medium 1 transported by a paper feed roller 7, guide roller 8, and guides 6, 9 and 10, to apply liquid water to the recording medium 1 before print recording on the recording medium 1 is performed by ejecting ink through an ejection surface 2 of a recording head 3. The recording head is carried by a carriage 4, which moves along guide shaft 5. In this case, the roller 11 containing water is brought into contact with a reverse surface of the recording medium 1 at the back of the print recording surface and the water flows through unshown pores in the roller 11 onto the back of the recording medium.

Figure 2:
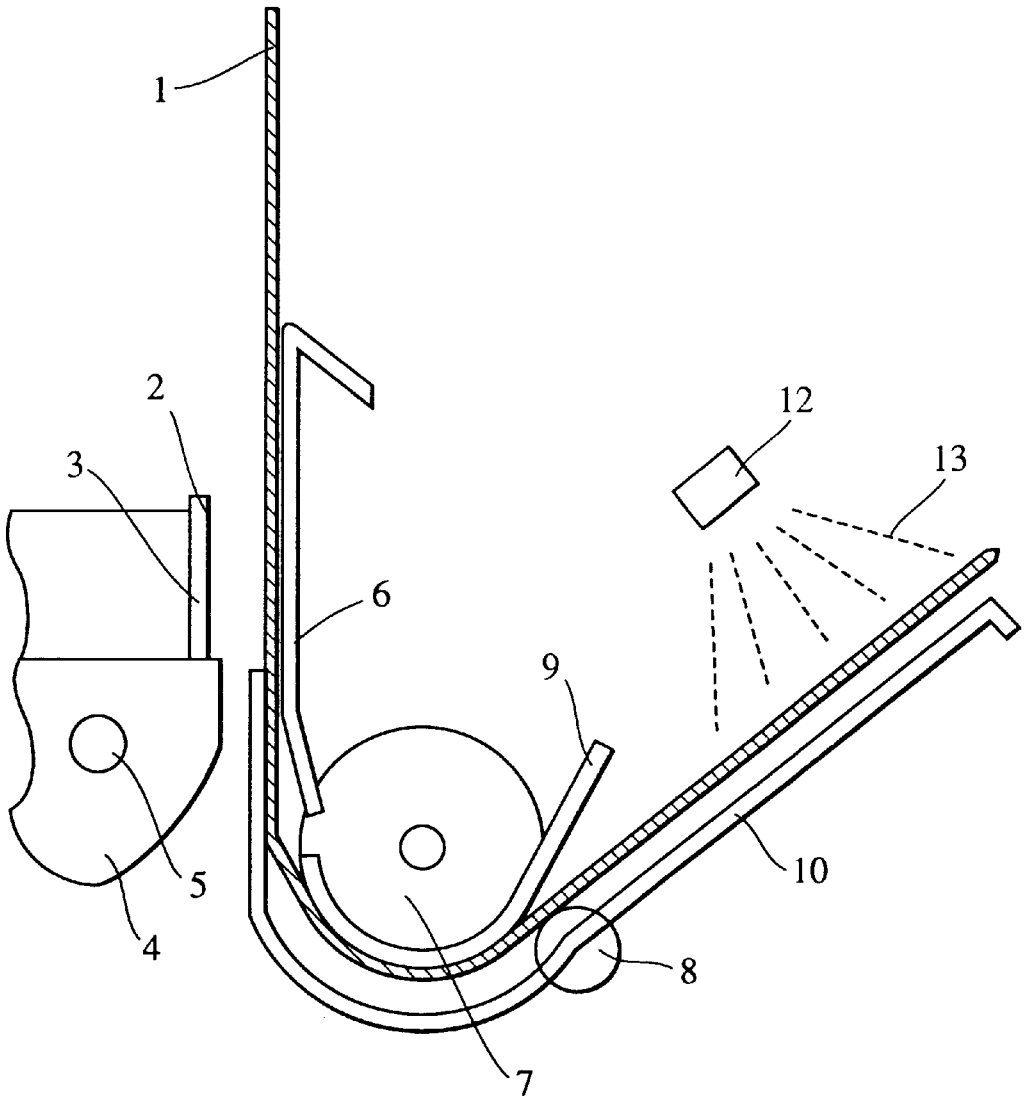
FIG. 2 is a schematic longitudinal sectional view of another ink jet recording apparatus to which the ink jet recording method of the present invention is applied.
Figure 3:
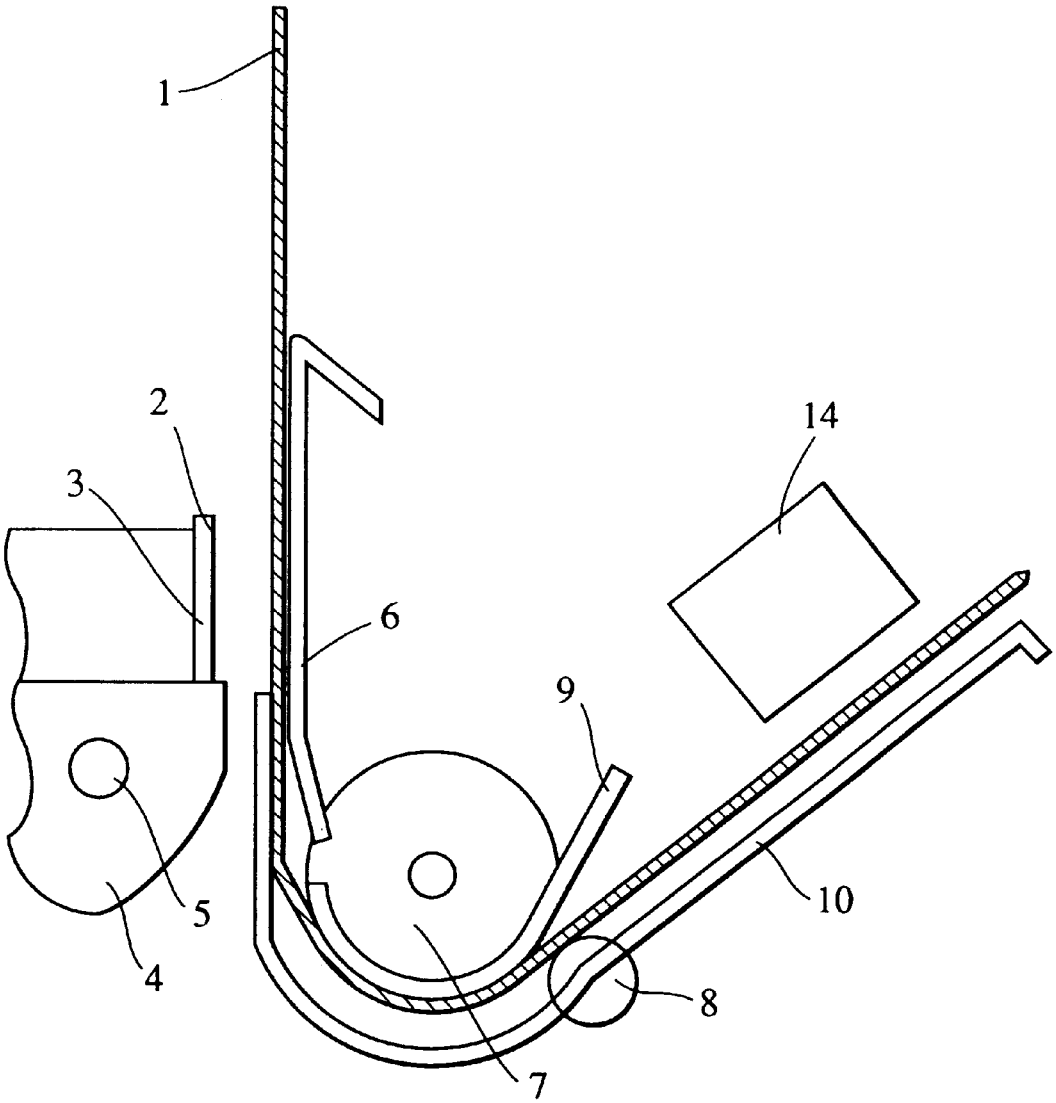
FIG. 3 is a schematic longitudinal sectional view of a further ink jet recording apparatus to which the ink jet recording method of the present invention is applied.

FIGS. 2 and 3 show systems in which liquid water is applied to a reverse surface of a recording medium 1 at the back of a print recording surface before print recording, as in the case of the system shown in FIG. 1. In the system shown in FIG. 2, however, liquid water is applied by spraying atomized liquid water 13 to the reverse surface of the recording medium 1 from a spray 12. In the system shown in FIG. 3, liquid water is applied to the recording medium 1 with a humidifier 14.

Figure 4:
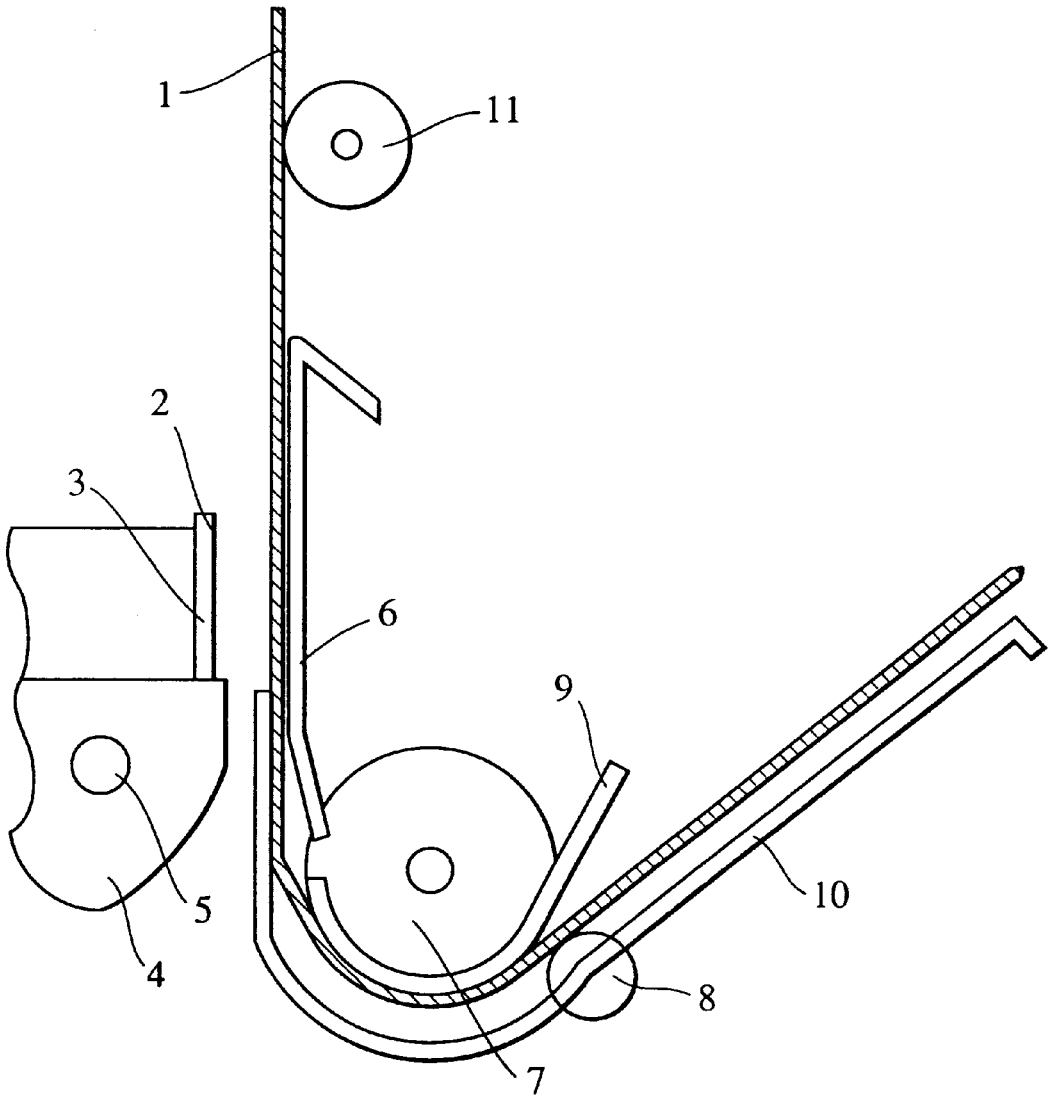
FIG. 4 is a schematic longitudinal sectional view of yet a further ink jet recording apparatus to which the ink jet recording method of the present invention is applied.
Figure 5:
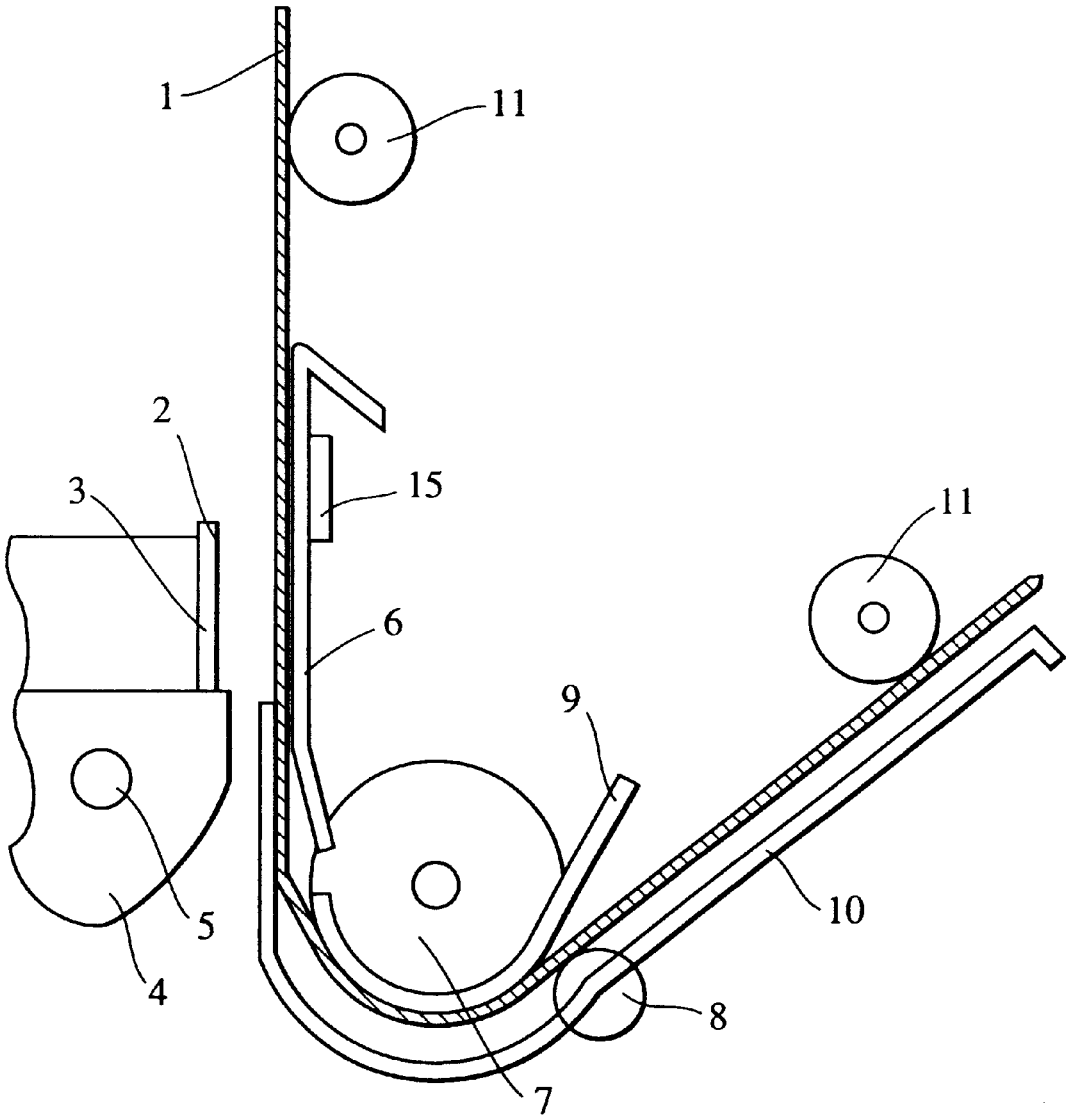
FIG. 5 is a schematic longitudinal sectional view of still a further ink jet recording apparatus to which the ink jet recording method of the present invention is applied.

FIGS. 4 and 5 show systems in which a roller 11 containing water is brought into contact with a recording medium 1 to apply liquid water to the recording medium after recording unlike the above examples. In the case of certain kinds of recording media 1, there is a risk of ink being blurred if the roller 11 containing water is brought into contact with the recording medium 1 before print recording. It is preferable to use these systems in such a case. Also, in these systems, it is preferable to apply liquid water to a reverse surface of the recording medium 1 at the back of a print recording surface.

In one preferred embodiment of the method of the present invention, as shown in FIG. 5, only a printed recording portion of the recording member 1 is dried with a fixation heater 15 to eliminate the possibility of blurring at the time of printing. Then, printing is performed and liquid water is thereafter supplied to the recording medium 1 by bringing the roller 11 containing water into contact with the reverse surface of the recording medium 1.

Figure 6:
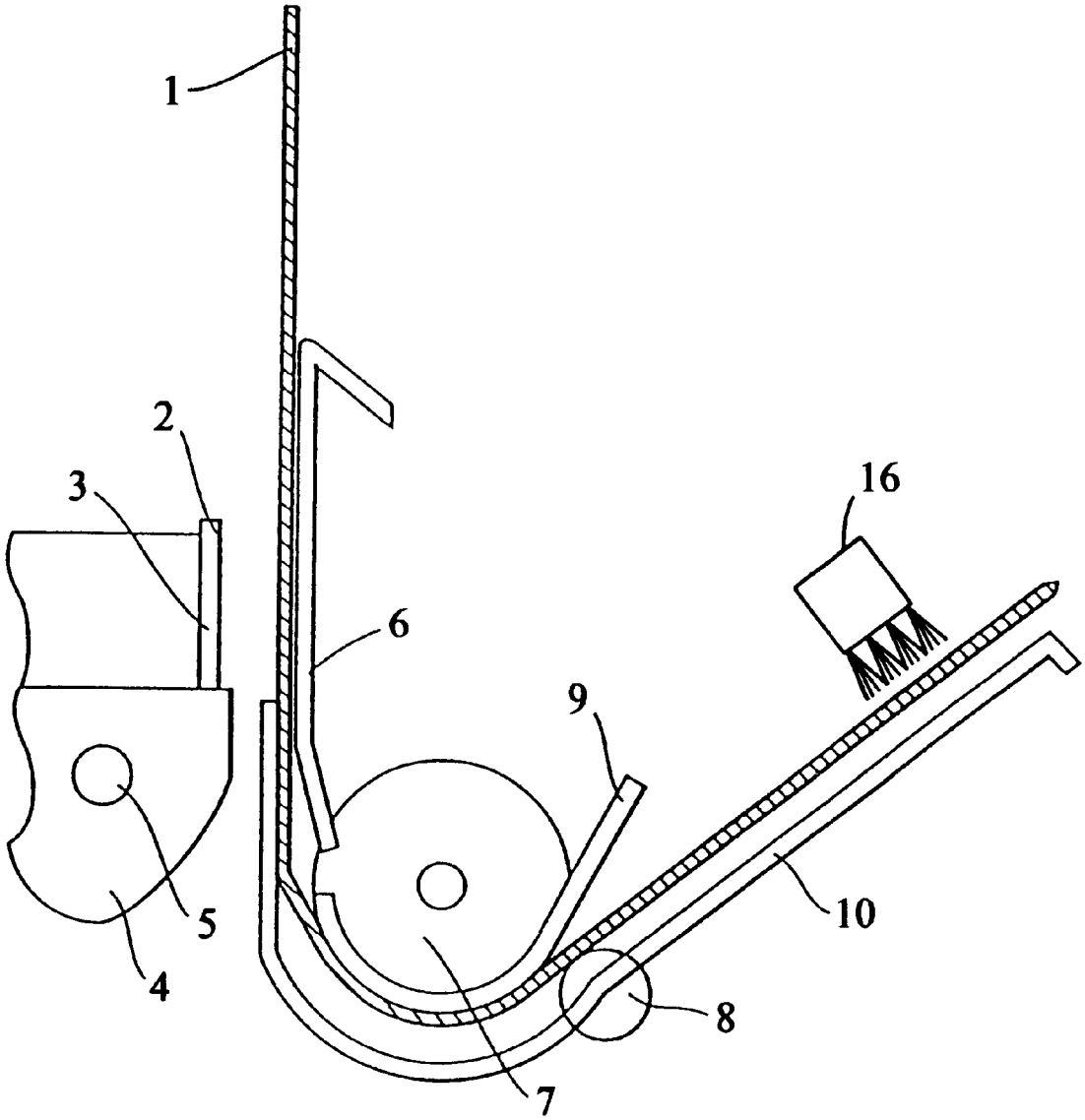
FIG. 6 is a schematic longitudinal sectional view of an even further ink jet recording apparatus to which the ink jet recording method of the present invention is applied.

FIG. 6 shows a system in which a brush-like member 16 for supplying water is brought into contact with a reverse surface of a recording medium 1 before print recording. The brush-like member 16 may have capillaries therein filled with water so that the water can be applied to the recording medium by osmotic pressure or capillary action.

An example of printing performed in accordance with the present invention will be described below.

EXAMPLE

In this example, 3 wt % of C. I. Direct Black 2, 5 wt % of glyceriol, 3 wt % of ethyl alcohol, and 89 wt % of pure water were mixed and sufficiently agitated for dissolution. Thereafter, the mixture was pressure-filtered with a filter having a pore size of 0.45 $\mu$m (Phloropore Filter, a product from Sumitomo Electric Industries, Ltd.) to obtain an ink.

Recording was, performed on a wood free paper with each ink jet recording apparatus to which the ink jet recording systems shown in FIGS. 1 to 6 were applied.

The obtained printed paper was left for 5 minutes after printing and was then immersed in still water for 3 minutes. The printing density after immersion in still water relative to the printing density before immersion in still water was measured with a printing density reader, such as a Macbeth RD 915 (a product from Macbeth). The printing density remaining rate was 85% or higher with respect to each apparatus. Thus, prints having improved water fastness properties were obtained.

On the contrary, the printing density remaining rate of the printed matter, which was made without providing water on the paper was about 40%.

The individual components shown in outline or designated by blocks in the drawings are all well-known in the image recording arts and their specific construction and operation are not critical to the operation or best mode for carrying out the invention.

While the present invention has been described with respect to what i, presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

As described above, the ink jet recording method of the present invention makes it possible to remarkably improve the water-fastness property of a printed medium.

What is claimed is:

1. An ink jet recording method comprising the steps of:

applying droplets of ink containing at least a water-soluble dyestuff and a solvent to a recording medium; and applying water, the amount of which is 7 to 20 wt % of the recording medium, to a reverse surface of the recording medium at at least one of a time before, during and after said step of applying the ink, thereby increasing water-fastness of a printed image, wherein at least a portion of the water-soluble dyestuff remains on a recording surface of the recording medium and at least a portion of the solvent is dispersed to the reverse surface of the recording medium by an osmotic pressure phenomenon which occurs in the recording medium.

2. An ink jet recording method according to claim 1, wherein the amount of water applied is within the range of 7 to 15 wt % of the recording medium.

3. An ink jet recording method according to claim 1, wherein in said water applying step, the water is applied with a porous drum.

4. An ink jet recording method according to claim 1, wherein in said water applying step, the water is applied with a brush-like member.

5. An ink jet recording method according to claim 1, wherein in said water applying step, the water is applied with a humidifier.

6. An ink jet recording method according to claim 1, wherein in said water applying step, the water is applied with an atomizer.

7. A method for providing a water-fastness property to a printed image formed with a water-soluble dyestuff, said method comprising the steps of:

applying droplets of ink containing at least the water-soluble dyestuff and a solvent to a recording medium; and applying water, the amount of which is 7 to 20 wt % of the recording medium, to a reverse surface of the recording medium at at least one of a time before, during and after said step of applying the inks, wherein at least a portion of the water-soluble dyestuff remains on a recording surface of the recording medium and at least, a portion of the solvent is dispersed to the reverse surface of the recording medium by an osmotic pressure phenomenon which occurs in the recording medium.

8. A method according to claim 7, wherein the amount of water applied is within the range of 7 to 15 wt % of the recording medium.

9. An ink jet recording method according to claim 7, wherein in said water applying step, the water is applied with a porous drum.

10. An ink jet recording method according to claim 7, wherein in said water applying step, the water is applied with a brush-like member.

11. An ink jet recording method according to claim 7, wherein in said water applying step, the water is applied with a humidifier.

12. An ink jet recording method according to claim 7, wherein in said water applying step, the water is applied with an atomizer.

13. A method of producing a water-fastness printed image formed with a water-soluble dyestuff, said method comprising the steps of:

applying droplets of ink containing at least the water-soluble dyestuff and a solvent to a recording medium; and applying water, the amount of which is 7 to 20 wt % of the recording medium, to a reverse surface of the recording medium at at least one of a time before, during and after said step of applying the inks, wherein at least a portion of the water-soluble dyestuff remains on a recording surface of the recording medium and at least a portion of the solvent is dispersed to the reverse surface of the recording medium by an osmotic pressure phenomenon which occurs in the recording medium.

14. A method according to claim 13, wherein the amount of water applied is within the range of 7 to 15 wt % of the recording medium.

15. An ink jet recording method according to claim 13, wherein in said water applying step, the water is applied with a porous drum.

16. An ink jet recording method according to claim 13, wherein in said water applying step, the water is applied with a brush-like member.

17. An ink jet recording method according to claim 13, wherein in said water applying step, the water is applied with a humidifier.

18. An ink jet recording method according to claim 13, wherein in said water applying step, the water is applied with an atomizer.

* * * * *

UNITED STATES PATENT AND TRADEMARK OFFICE

CERTIFICATE OF CORRECTION

PATENT NO. : 5,984,466

DATED : November 16, 1999

INVENTOR(S) : NAGASHIMA ET AL.

It is certified that error appears in the above-identified patent and that said Letters Patent is hereby corrected as shown below:

ON THE TITLE PAGE:

Item

[56] References Cited:

FOREIGN PATENT DOCUMENTS, "04197637" should read --4-197637--.

COLUMN 2:

Line 23, "at:" should read --at--.

COLUMN 3:

Line 8, "water fastness" should read --water-fastness--.

Line 32, "salvation" should read --solvation--.

Line 39, "Ls" should read --is--.

Line 45, "(concentration" should read --concentration--.

COLUMN 5:

Line 25, "anticeptic," should read --antiseptic,--.

UNITED STATES PATENT AND TRADEMARK OFFICE

CERTIFICATE OF CORRECTION

PATENT NO. : 5,984,466

DATED : November 16, 1999

INVENTOR(S) : NAGASHIMA ET AL.

It is certified that error appears in the above-identified patent and that said Letters Patent is hereby corrected as shown below:

COLUMN 8:

Line 20, "water-fastness" should read --water-fast--.

Line 29, "inks," should read --ink,--.

Signed and Sealed this

Second Day of January, 2001

*Attest:*

*Attesting Officer*

Q. TODD DICKINSON

*Commissioner of Patents and Trademarks*